United States Patent [19]

Liebeskind

[11] 4,114,307

[45] Sep. 19, 1978

[54] ADJUSTABLE CONFIGURATION TOY

[76] Inventor: Arthur S. Liebeskind, 5905 Bonnie View Dr., Baltimore, Md. 21219

[21] Appl. No.: 765,835

[22] Filed: Feb. 4, 1977

[51] Int. Cl.[2] ..... A63H 33/10

[52] U.S. Cl. ..... 46/1 R; 46/29

[58] Field of Search ..... 46/1 R, 27–29

[56] References Cited

U.S. PATENT DOCUMENTS

| | | | |
|---|---|---|---|
| 1,541,004 | 6/1925 | Taylor | 46/29 |
| 1,860,627 | 5/1932 | Sherman | 46/29 |
| 2,732,654 | 1/1956 | Sullivan | 46/28 |

FOREIGN PATENT DOCUMENTS

| | | | |
|---|---|---|---|
| 883,895 | 12/1961 | United Kingdom | 48/28 |

*Primary Examiner*—Russell R. Kinsey
*Assistant Examiner*—Robert F. Cutting
*Attorney, Agent, or Firm*—Walter G. Finch

[57] ABSTRACT

This invention is for an adjustable configuration toy which can be adapted to form various configurations, such as the letters of the alphabet, numerals, truss and beam arrangements and the like. It consists of a plurality of module units which can be coupled together at their ends by male and female coupling elements.

2 Claims, 5 Drawing Figures

ADJUSTABLE CONFIGURATION TOY

BACKGROUND AND SUMMARY OF THE INVENTION

This invention relates to toy devices for use by children or minors, and more particularly to an adjustable configuration toy formed of module units.

In the past, it has always been difficult to teach the letters of the alphabet and to form numerals in the education of minors.

It is an object of this invention, therefore, to provide an adjustable configuration toy which can be utilized to teach children how to readily and easily form letters of the alphabet or numerals for educational purposes and to keep them usefully occupied.

Another object of this invention is to provide an educational toy structure formed of identical modules which can be used as an educational aid for children.

Still even another object of this invention is to provide an educational toy which can be used by all types of children on a worldwide basis for teaching the formation of various types of configuration, such as the alphabet or numerals or various types of structures.

Another object of this invention is to provide an economical toy that can be readily assembled for educational or amusement purposes and quickly disassembled for storage thereof.

DESCRIPTION OF THE PREFERRED EMBODIMENT

Figure 1:
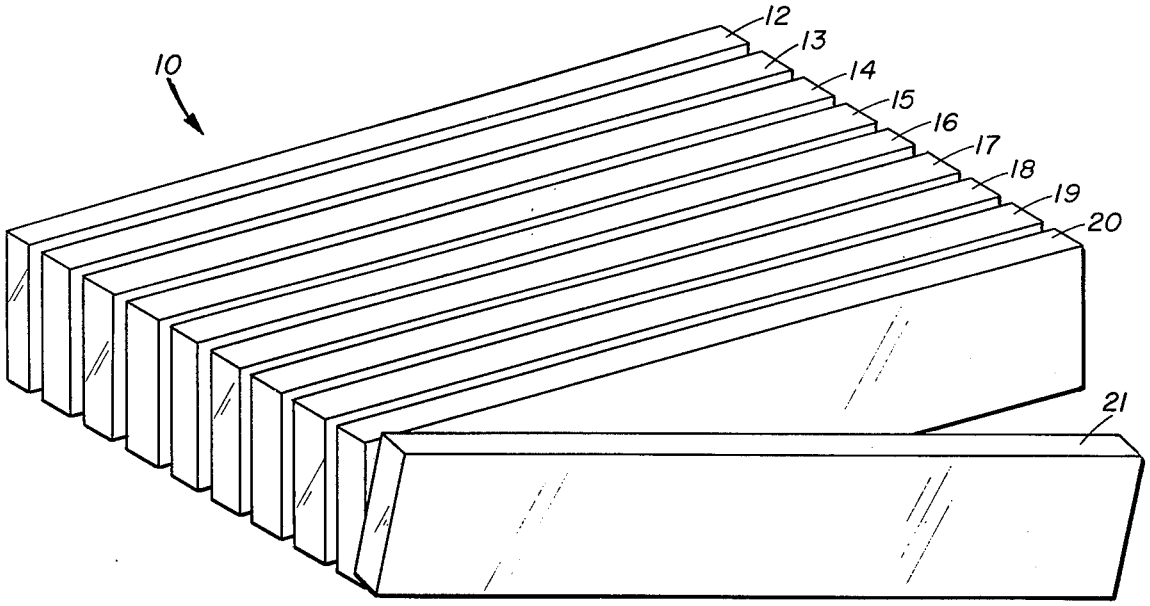
FIG. 1 is a perspective view of an adjustable configuration toy incorporating features of my invention.

Referring now to FIG. 1 of the drawing, there is shown an adjustable configuration toy 10 used for forming the letters of the alphabet, numerals, or other configurations.

This toy 10 is formed of a plurality of identical modules or units, such as 12, 13, 14, 15, 16, 17, 18, 19, 20, and 21, which are coupled together at their respective ends as will be described below.

Each module or unit 12, 13, 14, 15, 16, 17, 18, 19, 20, and 21, is of substantially rectangular shape lengthwise and crosswise.

Figure 3:
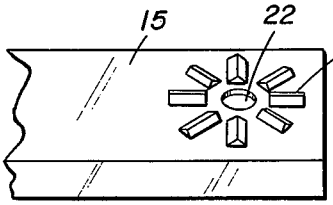
FIG. 3 is a view of one end of a single unit of the adjustable configuration toy of FIG. 1 showing a female coupling element.
Figure 4:
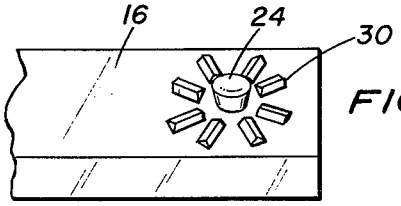
FIG. 4 is a view of one end of a single unit of the adjustable configuration toy of FIG. 1 showing a male coupling element.

Referring now to FIGS. 3 and 4, one end of a module, for example, module 15, is formed with an aperture or recess 22 therein with a plurality of spaced detents 15 formed around the periphery of the aperture or recess 22 and spaced outwardly therefrom.

The end of module unit 16, on the other hand, which engages with the end just described for module 15, is provided with a male coupling pin 24 having a locking lip 26 and a corresponding number of evenly spaced detents 30 likewise spaced from the male coupling pin 24 and when rotated fit and engage between the detents 28 of the end of module 15.

Each module 12, 13, 14, 15, 16, 17, 18, 19, 20, and 21, is thus formed with a female coupling aperture or recess at one end with detents 28, and on the opposite face at the opposite end of each corresponding module 12, 13, 14, 15, 16, 17, 18, 19, 20, and 21 with a male coupling pin 24 and a corresponding number of detents 30.

Figure 2:
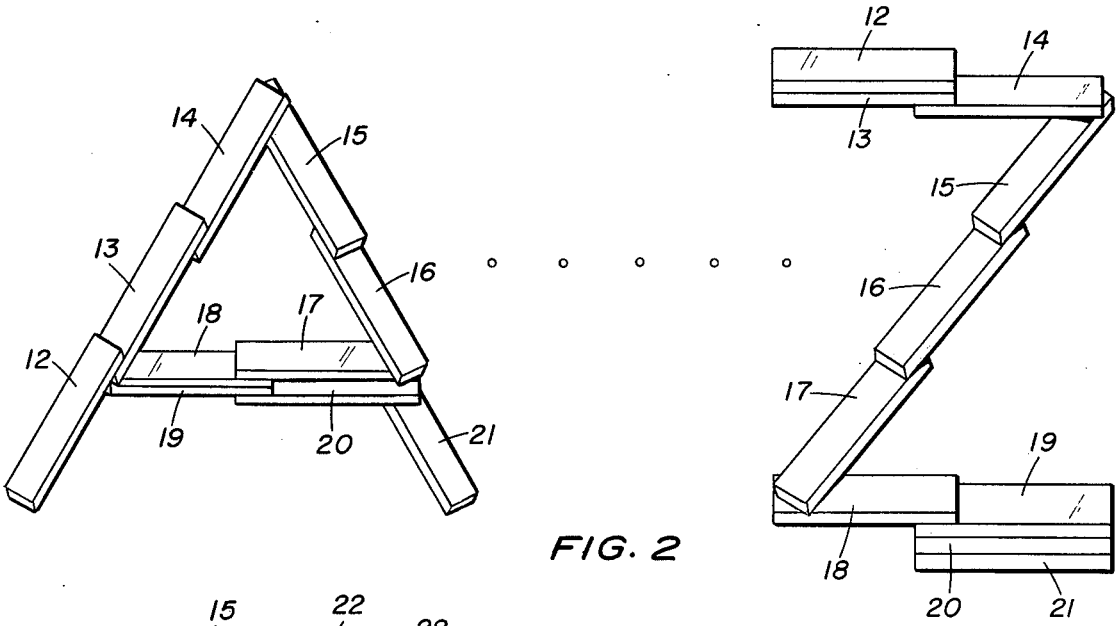
FIG. 2 is a perspective view showing the adjustable configuration toy of FIG. 1 formed into two letters of the alphabet.
Figure 5:
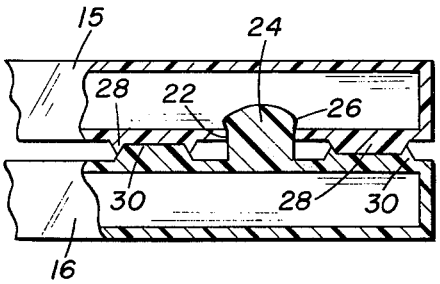
FIG. 5 is a cross section view showing the coupling arrangement between two adjacent units.

Referring now to FIG. 5, there is shown the ends of the modules 15 and 16 of FIGS. 3 and 4 assembled in an operative positioned so as to couple two modules 15 and 16 together to form various types of configurations of the letters of the alphabet, such as "A" or "Z" as shown in FIG. 2.

Thus any number of modules 12, 13, 14, 15, 16, 17, 18, 19, 20, 21, or more or less, can be used to form any of the letters of the alphabet, numerals, truss or beam arrangements, or any shape or configuration desired.

If desired the coupling elements can be arranged on the same side of each module 12, 13, 14, 15, 16, 17, 18, 19, 20, and 21, for example a coupling male element can be located at an end of a module unit and a female coupling element at the opposite end and on the same side of the module unit. Any other arrangement can be used as required.

As can be readily understood the aforegoing description of the preferred embodiment of the invention can be configured in different modes to provide for various arrangements of the modules. Such configuring in different modes that utilize the novel and unique concept of this invention are within the scope and intent of this invention.

What is claimed is:

1. An adjustable configuration toy, having a plurality of identical module units that are movably and removably coupled to each other sequentially, one after the other, in a manner so that each module unit is rotatable about the point of coupling with the next sequential unit, and capable of being disassembled into the individual identical module units, and comprising:

a plurality of identical module units, each sequentially coupled to each other at the interface of the side of one unit with the side of the next sequential unit, said coupling being near the end of the interfacing sides;

a plurality of apertures, one said aperture in each said identical module unit, said aperture located at the center of the point of coupling of one unit to the next sequential module unit, said aperture serving as the female element of said coupling;

a plurality of pins, one said pin in each said identical module unit, said pin being integral with side of each said identical module unit and located at the center of the point of coupling of one module unit to the next sequential module unit, said pin serving as the male element of said coupling and at assembly being opposite said female element of coupling of next adjacent sequential module unit as the sides of two sequential module units interface, said male element and said female element of coupling of each identical module unit being located at opposite ends and on opposite side faces of said identical module unit;

a plurality of spaced detent ridges radially surrounding the periphery of each said female element and each said male element of said coupling, said detent ridges being integral with the identical module unit on which they occur, the number of spaced detent ridges radially surrounding each said female element and each said male element of said coupling being equal and the same, said detent ridges of said female element engaging said detent ridges of said male element at assembly and when an identical module unit is rotated about the center of coupling;

a locking lip on the outboard end of each said pin that is the male element of said coupling to secure the module units together when the male element of the coupling is inserted in the female element of the coupling for assembly of the identical module units in a sequential manner, said locking lip being capable of withdrawal for disassembly of the adjustable configuration toy.

2. An adjustable configuration toy as recited in claim 1, wherein each module unit is of substantially rectangular shape lengthwise and crosswise and of a hollow cross-section.

* * * * *